US007165487B2

(12) United States Patent
Kim

(10) Patent No.: US 7,165,487 B2
(45) Date of Patent: Jan. 23, 2007

(54) CYLINDER PROTECTIVE APPARATUS FOR PREVENTING STRANGE NOISE

(75) Inventor: Ki Jung Kim, Changwon (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 24 days.

(21) Appl. No.: 11/091,184

(22) Filed: Mar. 28, 2005

(65) Prior Publication Data

US 2005/0247191 A1 Nov. 10, 2005

(30) Foreign Application Priority Data

May 4, 2004 (KR) ..... 10-2004-0031399

(51) Int. Cl.
*F01B 29/00* (2006.01)
*E02F 9/22* (2006.01)

(52) U.S. Cl. ..... 92/165 R; 92/146; 92/161

(58) Field of Classification Search ..... 92/143, 92/161, 165 R
See application file for complete search history.

(56) References Cited

U.S. PATENT DOCUMENTS 4,949,593 A * 8/1990 Vignoli et al. ..... 74/566
5,152,351 A * 10/1992 Rieger ..... 92/53
5,386,652 A * 2/1995 Ramun ..... 37/406
6,843,005 B1 * 1/2005 Clapper ..... 37/406

FOREIGN PATENT DOCUMENTS

| | | | |
|---|---|---|---|
| JP | 01 098701 | | 4/1989 |
| JP | 08 296611 | | 11/1996 |
| JP | 10292426 | A * | 11/1998 |
| JP | 2001073405 | A * | 3/2001 |
| JP | 2002 013507 | | 1/2002 |
| JP | 2002 021812 | | 1/2002 |
| JP | 2 385 379 | | 8/2003 |

OTHER PUBLICATIONS

Patent Abstracts of Japan of JP 2002 021812 dated Jan. 23, 2002.
Patent Abstracts of Japan of JP 08 296611 dated Nov. 12, 1996.
Patent Abstracts of Japan of JP 2002 013507 dated Jan. 18, 2002.
Patent Abstracts of Japan of JP 01 098701 dated Apr. 17, 1989.

* cited by examiner

*Primary Examiner*—Thomas E. Lazo
(74) *Attorney, Agent, or Firm*—Ladas and Parry LLP

(57) ABSTRACT

Disclosed is a cylinder protective apparatus for preventing strange noise in which an impact damper is fixed to an inner side of a cylinder cover to prevent collision between the cylinder cover and a cylinder or a cylinder guide from occurring, which may be caused by vibration generated when a heavy construction equipment such as an excavator works. Since the cylinder protective apparatus is provided with the impact damper, strange noise due to a gap generated between the cylinder cover and the cylinder or the cylinder guide can be prevented from occurring.

5 Claims, 3 Drawing Sheets

CYLINDER PROTECTIVE APPARATUS FOR PREVENTING STRANGE NOISE

CROSS-REFERENCE TO RELATED APPLICATIONS

This application claims benefit under 35 U.S.C. § 119 from Korean Patent Application No. 2004-31399, filed on May 4, 2004, the entire content of which is incorporated herein by reference.

BACKGROUND OF THE INVENTION

1. Field of the Invention

The present invention relates to a cylinder protective apparatus for use in a heavy construction equipment such as an excavator, and more particularly to, a cylinder protective apparatus for preventing strange noise in which a cylinder and a cylinder rod are prevented from being damaged and strange noise due to a gap between a fitting portion of the cylinder rod and a cylinder cover is prevented from being generated.

2. Description of the Related Art

Generally, a hydraulic cylinder for use in a heavy construction equipment such as an excavator works as a cylinder rod moves elastically. In this case, the cylinder rod is externally exposed. Waste such as dust stuck on a surface of the cylinder rod may enter the cylinder and damage the cylinder rod because of a poor working area where dust or soil is continuously generated. Also, the cylinder rod may directly be subjected to impact due to stone or rock. Moreover, the cylinder rod may be damaged by chemical action of waste stuck on its surface. To solve such problems, a cover is used to protect the cylinder rod.

FIG. 1 illustrates appearance of a related art excavator. As shown in FIG. 1, the related art excavator is provided with a boom cylinder 20 to move a boom 10 and a cylinder cover 30 at an outer side of the boom cylinder. The cylinder cover 30 has an end fixed to a head portion of the cylinder rod by a cover fitting bolt 40 to move along a cylinder guide of the cylinder when the cylinder rod moves elastically.

FIG. 2 is a sectional view taken along line A—A of FIG. 1. As shown in FIG. 2, a cover guide 50 connected with the cylinder cover 30 is in contact with a cylinder guide 60 connected with the boom cylinder 20 when the cylinder rod moves elastically. The cylinder rod is covered with the cylinder cover 30 so as not to be externally exposed.

In the related art, the cylinder rod may be protected so as not to be externally exposed. However, the cylinder cover may collide with the cylinder or the cylinder guide at the gap generated between the inner side of the cylinder cover 30 and the cylinder or the cylinder guide due to vibration generated when the heavy construction equipment such as an excavator works. For this reason, the cylinder rod may be damaged and strange noise may occur.

SUMMARY OF THE INVENTION

Accordingly, the present invention is directed to a cylinder protective apparatus for preventing strange noise that substantially obviates one or more problems due to limitations and disadvantages of the related art.

An object of the present invention is to provide a cylinder protective apparatus for preventing strange noise in which collision between a cylinder cover and a cylinder or a cylinder guide is prevented from occurring, which may be caused by vibration generated when a heavy construction equipment works.

Another object of the present invention is to provide a cylinder protective apparatus for preventing strange noise in which strange noise due to a gap generated between a cylinder cover and a cylinder or a cylinder guide is prevented from occurring.

To achieve these objects and other advantages and in accordance with the purpose of the invention, as embodied and broadly described herein, a cylinder protective apparatus includes a cylinder cover whose one end is fixed to a head portion of a cylinder rod and the other end is extended in a length direction of a cylinder to protect the cylinder rod and the cylinder, moving as the cylinder rod moves elastically, a cylinder guide fixed to the outer circumference of the cylinder to guide motion of the cylinder cover, and an impact damper fixed to an inner side of the cylinder cover, having one side with a shape corresponding to that of the cylinder guide to adjoin one side of the cylinder guide.

Preferably, the cylinder cover has both ends bent in a horizontal direction to form an inner chamber having a U shaped section, the impact damper is fixed to the inner chamber formed in the cylinder cover and has a groove at one side, and the cylinder guide is inserted into the groove of the impact damper to move the cylinder cover.

Preferably, the impact damper has a through hole therein fixed by a bolt.

Preferably, the impact damper is made of polyurethane.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
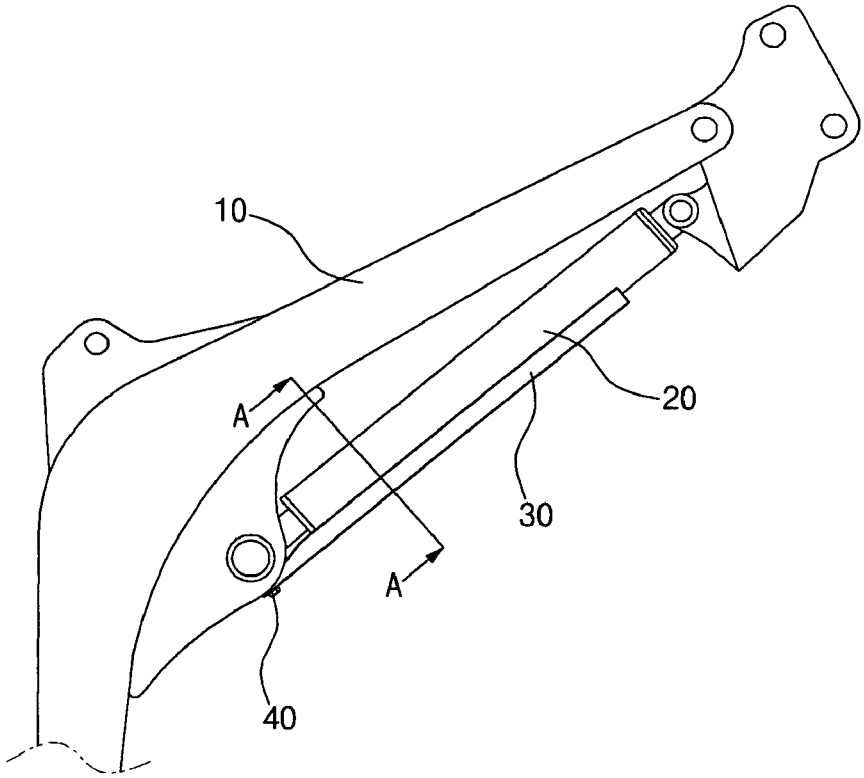
FIG. 1 illustrates appearance of a general excavator.
Figure 2:
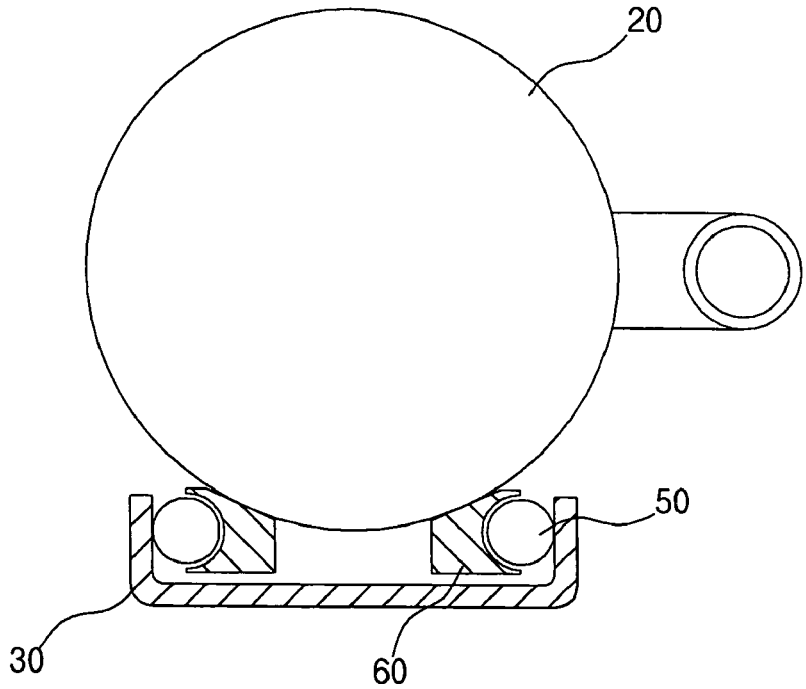
Fig. 2 Prior Art
FIG. 2 is a sectional view illustrating a cylinder protective apparatus according to the related art.
Figure 3:
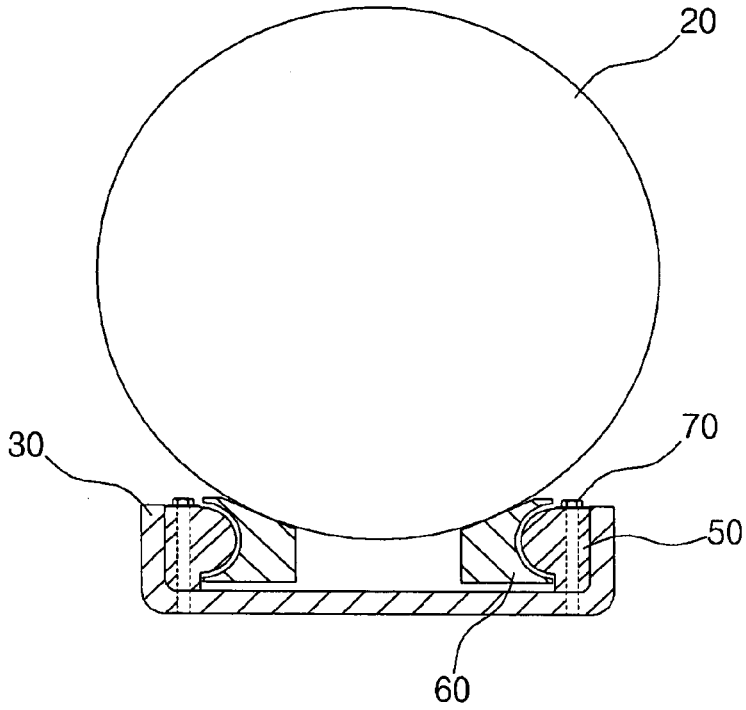
FIG. 3 is a sectional view illustrating a cylinder protective apparatus according to the first embodiment of the present invention.

As shown in FIG. 3, an impact damper 50' that acts as a cover guide 50 of the related art is fixed to an inner side of a cylinder cover 30. Since the impact damper 50' has a shape corresponding to that of a cylinder guide 60, the cylinder cover 30 can be moved along the cylinder guide 60 provided on the outer circumference of a cylinder.

Further, since the impact damper 50' is fixed in contact with the inner side of the cylinder cover 30, collision between the inner side of the cylinder cover 30 and the cylinder guide 50 or strange noise can be prevented from occurring even in case that the cylinder cover 30 moves due to vibration. The impact damper 50' is made of polyurethane material and has a through hole to be easily fixed to or detached from the cylinder cover 30 by a bolt 70 for fitting the impact damper. The material or fixation of the impact damper is not limited to the above description.

Figure 4:
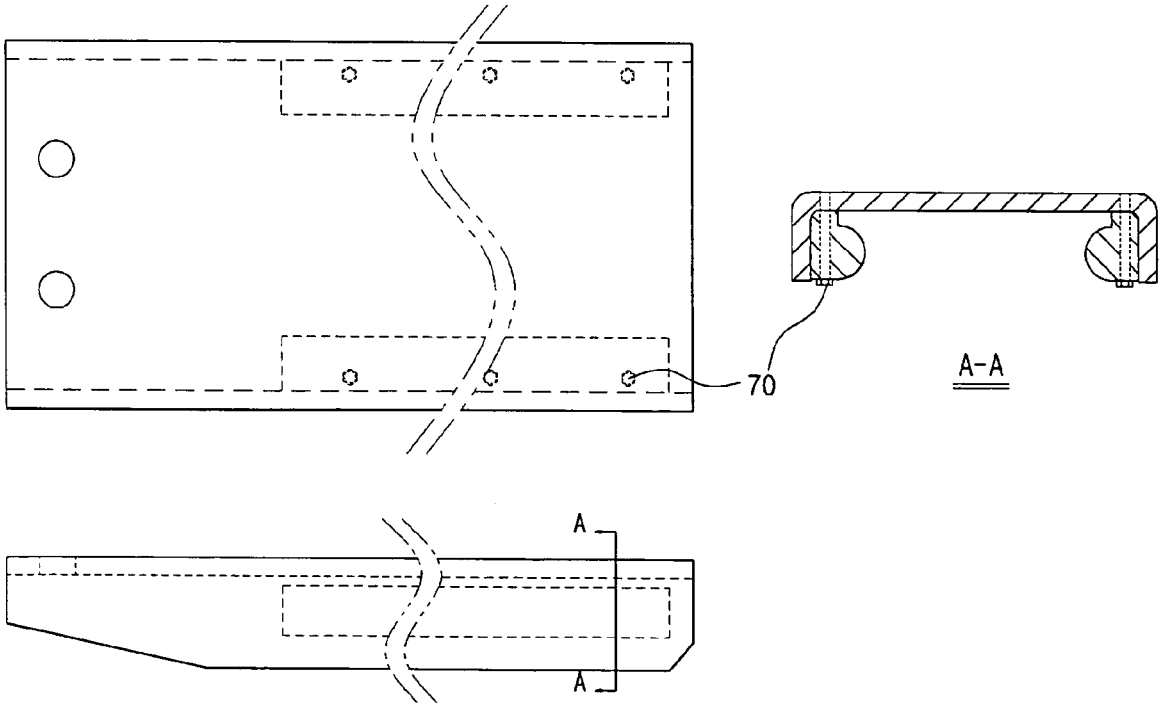
FIG. 4 is a sectional view taken along line A—A of a cylinder protective apparatus shown in FIG. 3.

Referring to FIG. 4, the impact damper 50' is fixed to the cylinder cover 30 by the bolt 70. Also, in the detailed sectional view taken along line A—A, one side of the impact damper 50' is protruded to correspond to the cylinder guide 60.

Figure 5:
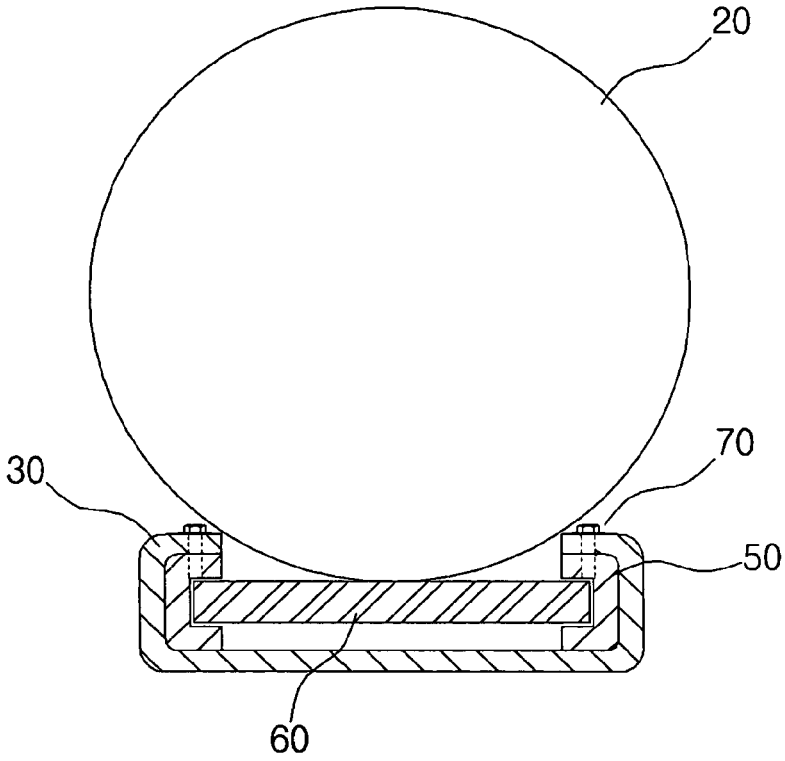
FIG. 5 is a sectional view illustrating a cylinder protective apparatus according to the second embodiment of the present invention.

FIG. 5 illustrates a cylinder cover 30 according to the second embodiment of the present invention. As shown in FIG. 5, the cylinder cover 30 has both ends bent in a horizontal direction to form an inner chamber having a U shaped section. The impact damper 50' is fixed to the inner chamber formed in the cylinder cover 30 and has a groove at one side. The cylinder guide has a shape corresponding to the groove so that it may be inserted into the groove to move the cylinder cover 30. Therefore, since the impact damper 50' is fixed to the cylinder cover 30, collision between the cylinder cover 30 and the cylinder guide 60 and strange noise may be avoided even in case that the cylinder cover moves due to vibration.

Figure 6:
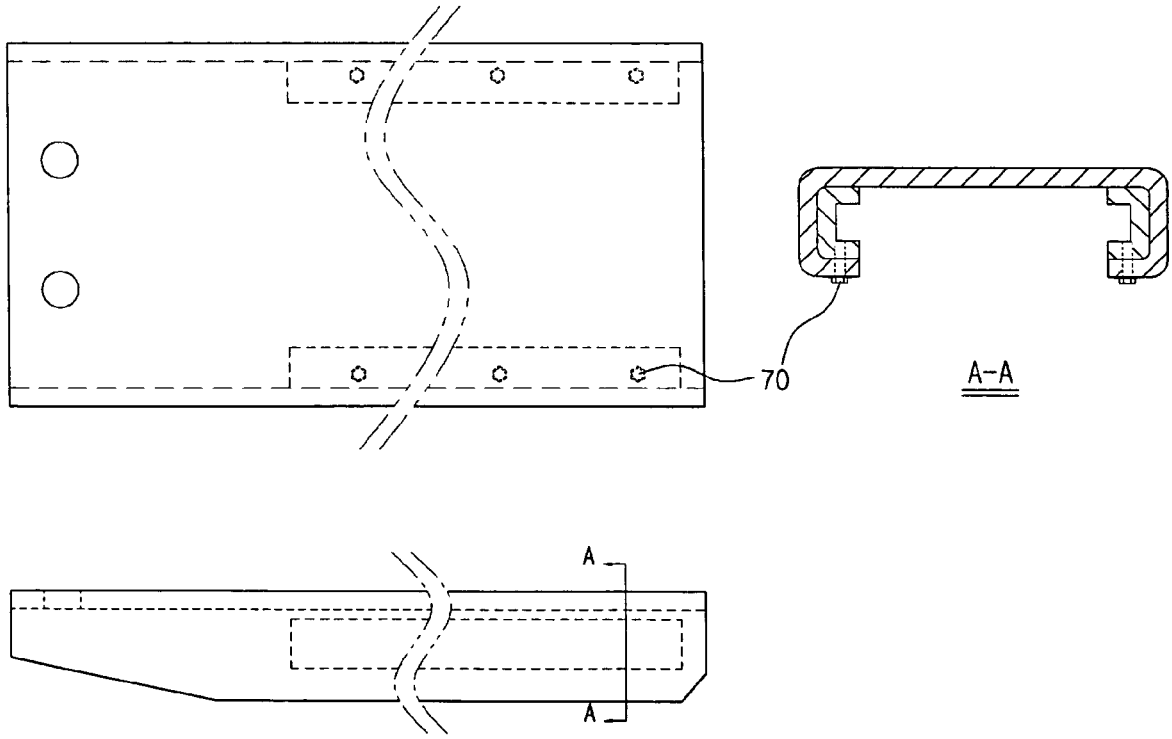
FIG. 6 is a sectional view taken along line A—A of a cylinder protective apparatus shown in FIG. 5.

Referring to FIG. 6, the cylinder cover 30 has both ends with a U shaped inner chamber, and the impact damper 50' having a through hole is fixed to the inner side of the cylinder cover by the bolt 70'. Also, a groove is formed at one side of the impact damper 50' to correspond to the shape of the cylinder guide 60.

As described above, the cylinder protective apparatus for preventing strange noise according to the present invention has the following advantages.

Collision between the cylinder cover and the cylinder or the cylinder guide can be prevented from occurring, which may be caused by vibration generated as the cylinder rod moves elastically when the heavy construction equipment works.

In addition, strange noise due to the gap generated between the cylinder cover and the cylinder or the cylinder guide can be prevented from occurring.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A cylinder protective apparatus comprising:

a cylinder guide fixed to the outer circumference of the cylinder to guide motion of the cylinder cover; and an impact damper fixed to an inner side of the cylinder cover, having one side with a shape corresponding to that of the cylinder guide to adjoin one side of the cylinder guide, wherein the impact damper is fixed to the inner chamber formed in the cylinder cover and has a groove at one side, and the cylinder guide is inserted into the groove of the impact damper to move the cylinder cover.

2. The cylinder protective apparatus according to claim 1, wherein the cylinder cover has both ends bent in a horizontal direction to form an inner chamber having a U shaped section.

3. The cylinder protective apparatus according to claim 2, wherein the impact damper has a through hole therein fixed by a bolt.

4. The cylinder protective apparatus according to claim 1, wherein the impact damper has a through hole therein fixed by a bolt.

5. The cylinder protective apparatus according to claim 1, wherein the impact damper is made of polyurethane.

* * * * *